US005695918A

United States Patent [19]

Gray et al.

[11] Patent Number: 5,695,918

[45] Date of Patent: Dec. 9, 1997

[54] CYANINE DYES WITH CHAIN SULFONE SUBSTITUENT PHOTOGRAPHIC MATERIALS COMPRISING

[75] Inventors: Colin James Gray, Wealdstone, England; John David Mee, Rochester, N.Y.; Derek David Chapman, Rochester, N.Y.; Kevin Wallace Williams, Rochester, N.Y.

[73] Assignee: Eastman Kodak Company, Rochester, N.Y.

[21] Appl. No.: 626,414

[22] Filed: Apr. 2, 1996

Related U.S. Application Data

[60] Provisional application No. 60/000,634 Jun. 29, 1995.

[51] Int. Cl.[6] ..... G03C 1/06

[52] U.S. Cl. ..... 430/522; 430/583; 430/584; 430/585; 430/588

[58] Field of Search ..... 430/583, 584, 430/585, 588, 522

[56] References Cited

U.S. PATENT DOCUMENTS

| | | | |
|---|---|---|---|
| 3,460,947 | 8/1969 | Ficken | 430/584 |
| 3,486,897 | 12/1969 | Oliver | 96/84 |
| 3,574,630 | 4/1971 | Heseltine et al. | 430/588 |
| 5,260,178 | 11/1993 | Harada et al. | 430/508 |

FOREIGN PATENT DOCUMENTS

| | | | |
|---|---|---|---|
| 2279463 | 1/1995 | United Kingdom | 430/588 |

*Primary Examiner*—Janet C. Baxter
*Attorney, Agent, or Firm*—Edith A. Rice

[57] ABSTRACT

A dye of the formula (I) below, and photographic elements having a light sensitive layer and which element contains such a dye:

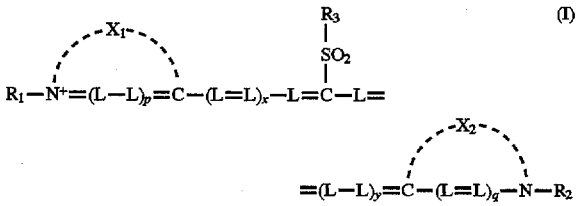

(I)

W1

$X_1$ and $X_2$ each independently represent the atoms necessary to complete a 5- or 6-membered heterocyclic nucleus;

x and y are, independently, integers from 0 to 3 provided x+y is no greater than 4;

p and q each independently represents 0 or 1, each L independently represents a methine group;

$R_1$ and $R_2$ each independently represents an alkyl group or an aryl group, and $R_3$ represents an alkyl group, aryl group or heteroaryl group;

W1 is a counterion as needed to balance the charge of the molecule.

23 Claims, No Drawings

CYANINE DYES WITH CHAIN SULFONE SUBSTITUENT PHOTOGRAPHIC MATERIALS COMPRISING

CROSS REFERENCE TO RELATED APPLICATION

Reference is made to and priority claimed from U.S. Provisional application Ser. No. US 60/000,634, filed 29 June 1995, entitled CYANINE DYES WITH CHAIN SULFONE SUBSTITUENT.

FIELD OF THE INVENTION

This invention relates to cyanine dyes having a chain sulfone substituent, and photographic elements containing such dyes.

BACKGROUND OF THE INVENTION

A wide variety of dyes is employed in photographic materials. In addition to diverse dyes used to form images in color photographic elements, spectral sensitizing dyes are used to extend the sensitivity of silver halides, which are inherently sensitive only to blue light, to other wavelengths of radiation. Dyes are also used in color photographic materials as filters, typically located in overcoats, interlayers or undercoats, to absorb incident radiation and improve image sharpness. Intergrain absorber dyes may also be added directly to a spectrally sensitized silver halide emulsion to absorb light and thereby modify the sensitivity of the emulsion.

Among the dyes commonly employed in photographic elements are the cyanines, which are discussed in T. H. James, editor, *The Theory of the Photographic Process,* 4th Edition, Macmillan, New York, 1977, Chapter 8, and in F. M. Hamer, *Cyanine Dyes and Related Compounds,* Wiley, New York, 1964. For different applications, dyes having maximum absorptions at various wavelengths are required. Thus, in general, any technique which allows adjustment of a dye's wavelength of maximum absorption is always useful.

Furthermore, a particular application of photographic elements is as photocomposition film for Graphic Arts. In such application it is important that the film be detectable inside film imagesetter devices: if the machine cannot detect the film, then the film would be unusable. Several different detector systems are known to be used by manufacturers of imagesetters. However, one system in particular, which employs an 880 nm infrared emitter/detector system, presents challenges with regard to the design of the film. An example of an imagesetter using such a system is the "Herkules", manufactured by Linotype Hell, which incorporates 880 nm GaAlas light emitting diodes in its detection system. The system works on the principle of comparing the detector current when no film is present to the case when film is present. When the film is present and interrupts the beam, some of the radiation is scattered or absorbed, thereby diminishing the amount of infrared radiation returned to the detector, causing an electrical current change to indicate the presence of the film.

In systems such as the "Herkules" system, normally the scattering of the 880 nm light by the silver halide emulsion is sufficient to enable film detection. However, advances in emulsion technology have made it possible to use emulsions with grains of mean edge length of 0.18 μm or less, often referred to as "fine grain" emulsions, at silver coverages of 3.5 g $Ag/m^2$ or less. The advantages of such films are reduced scatter, giving improved image quality, and materials savings by virtue of the high covering power of fine grain emulsions at (relatively) low silver coverages. The disadvantage is that such films may not be detected by 880 nm infrared emitter/detector systems.

U.S. Pat. No. 5,260,178 describes dyes said to facilitate detection of film position in an automatic developing machine, the detection device of which typically employs an energy source with maximum output at about 950 nm. These dyes have structures corresponding to formula (A):

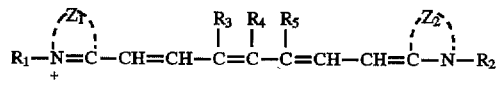

(A)

in which $Z_1$ and $Z_2$ each complete a heterocyclic nucleus, $R_1$ and $R_2$ and each represents an alkyl group, $R_3$ and $R_5$ each represents a hydrogen atom or, taken together, complete a five membered ring and $R_4$ represents a hydrogen atom or a monovalent group. In order that dyes of this type have a maximum absorption at 900 nm or longer, it is necessary that they be in an aggregated state.

Aggregates that shift the light absorption band bathochromically (that is, to longer wavelengths) with respect to the monomer absorption are commonly known as J-aggregates. The use of dyes in a J-aggregated state has certain disadvantages. For example, incorporation of other components within the same layer has been observed to modify the degree of aggregation or even eliminate aggregation altogether. In addition, certain aggregated dyes can degrade the mechanical properties of the gelatin layer. Dye aggregation may also retard the rate of removal of dyes during processing. In order to avoid such problems, it is preferable to use dyes in their monomeric state. However, heptamethine cyanines of the type described in U.S. Pat. No. 5,260,178 have absorption maxima, in their monomeric state, at too short a wavelength to be useful for detection devices using 880 nm radiation.

It would be desirable then, to provide a means for increasing the wavelength of maximum absorption of dyes used in photographic elements. It would be particularly desirable to provide a film with a dye that will facilitate film detection, particularly by longer wavelength light, which dye is preferably in a monomeric state.

SUMMARY OF THE INVENTION

The present invention generally provides dyes of the formula (I) below, and photographic elements having a light sensitive layer and which element contains such a dye:

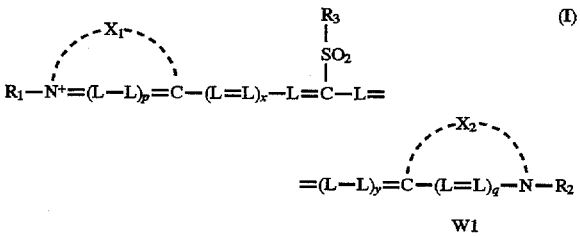

(I)

W1

$X_1$ and $X_2$ each independently represent the atoms necessary to complete a 5- or 6-membered heterocyclic nucleus;

x and y are, independently, integers from 0 to 3 provided x+y is no greater than 4;

p and q each independently represents 0 or 1, each L independently represents a methine group;

$R_1$ and $R_2$ each independently represents an alkyl group or an aryl group, and $R_3$ represents an alkyl group, aryl group or heteroaryl group;

W1 is a counterion (which includes one or more counterions) as needed to balance the charge of the molecule.

Dyes of the above type in photographic elements have a wavelength of maximum absorption which is shifted to a longer wavelength compared to dyes of the same structure having hydrogen or halogen instead of the $—SO_2R_3$ group. Furthermore, such dyes when appropriately substituted can be made both water soluble and non-aggregating in a gelatin coating, such features assisting in removal from the photographic element during processing.

EMBODIMENTS OF THE INVENTION

By reference to "under", "above", "below", "upper", "lower" or the like terms in relation to layer structure of a photographic element, is meant in this application, the relative position in relation to light when the element is exposed in a normal manner. "Above" or "upper" would mean closer to the light source when the element is exposed normally, while "below" or "lower" would mean further from the light source. Since a typical photographic element has the various layers coated on a support, "above" or "upper" would mean further from the support, while "below" or "under" would mean closer to the support. It will also be understood that reference to any broader formula includes reference to compounds with a narrower formula within the broader formula (for example, reference to a broader formula having particular substituents includes the possibility of narrower formulae following within the broader formula, having the same substituents where possible unless otherwise indicated).

Reference to a light sensitive layer or a light sensitive silver halide layer, refers to such layers which are sensitive to visible light (about 400–700 nm), ultraviolet light (about 300–400 nm) or infrared light (about 700–1500 nm). When reference in this application is made to a particular moiety as a "group", this means that the moiety may itself be unsubstituted or substituted with one or more substituents (up to the maximum possible number). For example, "alkyl group" refers to a substituted or unsubstituted alkyl, while "benzene group" refers to a substituted or unsubstituted benzene (with up to six substituents). Generally, unless otherwise specifically stated, substituent groups usable on molecules herein include any groups, whether substituted or unsubstituted, which do not destroy properties necessary for the photographic utility. Examples of substituents on any of the mentioned groups can include known substituents, such as: halogen, for example, chloro, fluoro, bromo, iodo; alkoxy, particularly those "lower alkyl" (that is, with 1 to 6 carbon atoms, for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid or acid salt groups such as any of those described below; and others known in the art. Alkyl substituents may specifically include "lower alkyl" (that is, having 1–6 carbon atoms), for example, methyl, ethyl, and the like. Further, with regard to any alkyl group or alkylene group, it will be understood that these can be branched or unbranched and include ring structures.

Preferably, in formula (I), p and q are both O. While the S of $—SO_2R_3$ may be bonded to a methine as shown, preferably it is bonded to the carbon of the methine group in the middle of the chain of methine groups represented by all the L groups shown (that is, x and y will be the same).

The substituents on the methine groups, L, of the dye of formula (I) can include substituents which form rings and x and y can both be 0. In particular, the two methine groups adjacent to the C to which $SO_2$ is bonded may be part of a ring such that the dye of formula (I) is of the following formula (II):

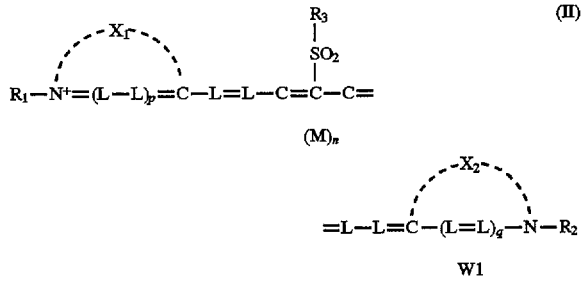

(II)

wherein each M is independently a methylene group and n is 2 or 3.

Dyes of formula (I) may be of formula (III) below:

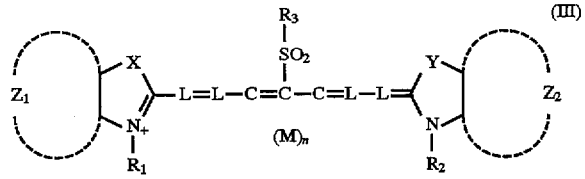

(III)

wherein:

$Z_1$ and $Z_2$ independently represent the atoms necessary to complete a benzene or naphthalene group;

X and Y independently represent O, Se, S, $NR_6$ or

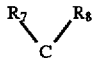

wherein $R_6$, $R_7$ and $R_8$ independently represent and H, alkyl group or aryl group, and the $R_7$ and $R_8$ in X may be the same as, or different from, the $R_7$ and $R_8$ in Y (although preferably in all of the formulae the $R_7$ in X is the same as $R_7$ in Y, while the $R_8$ in X is the same as the $R_8$ in Y). Since $R_7$ and $R_8$ may be substituted alkyl, this includes the possibility that they are joined to form a cycloalkyl group.

It will be understood though, that when reference is given to $Z_1$ and $Z_2$ being a benzene or naphthalene group, this excludes the possibility of them having another fused aryl ring. For example, "benzene group" excludes naphthalene group, while "naphthalene group" excludes an anthracene group.

The preferred structure for dyes of formula (I) are the heptamethine indolocyanine dyes of formula (IV) below:

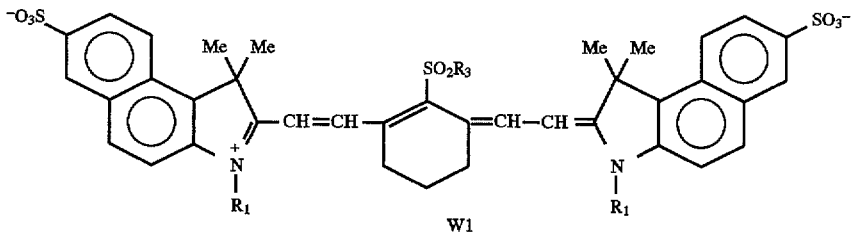

(IV)

wherein both $R_1$ groups are the same and represent a sulfoalkyl group.

Preferably the dyes of formula (I) (which again includes formula (II) through (IV)) are symmetrical about the L to which the —$SO_2R_3$ is appended. By symmetrical is meant that all groups and substituents to one side of that particular L are the same as those on the other side (thus, in such case $Z_1$ would be the same as $Z_2$, $R_1$ would be the same as $R_2$, both $R_7$ groups would be the same as each other, both $R_8$ groups would be the same as each other, and the like).

Dyes of formula (I) preferably have at least two acid or acid salt groups (most preferably 4, although 3 or more than 4, such as 6 or 8 could also be used) For example, $Z_1$, $Z_2$, $R_1$ and $R_2$ may each have at least one acid or acid salt group. The acid or acid salt groups described above, such groups include carboxy, sulfo, phosphato, phosphono, sulfonamido, sulfamoyl, or acylsulfonamido (groups such as —$CH_2$—CO—NH—$SO_2$—$CH_3$) groups. Note that reference to acid or acid salt groups are used to define only the, free acid groups or their corresponding salts, and do not include esters where there is no ionizable or ionized proton. Particularly preferred are the carboxy and sulfo groups (for example, 3-sulfobutyl, 4-sulfobutyl, 3-sulfopropyl, 2-sulfoethyl, carboxymethyl, carboxyethyl, carboxypropyl and the like). Particularly, it is preferred that $R_1$ and $R_2$ are both sulfoalkyl groups, particularly selected from the foregoing listed ones. Examples of suitable ions for W1 include sodium, potassium and hydrotriethylammonium.

In order to facilitate removal of dyes of formula (I) from photographic elements of the present invention, they are preferably present in the element in a monomeric state. By dyes being in the monomeric state is excluded the possibility of them being in a J- or H-aggregated state.

Preferably dyes of formula (I) are present in a photographic element of the present invention as an infrared absorber dye. Formula (I) dyes may be present in a light sensitive layer of the element or a non-light sensitive layer, although preferably in a non-light sensitive layer since they tend to be strong desensitizers.

The silver halide is spectrally sensitized with a spectral sensitizing dye. The spectral sensitizing dye will be a dye different from the dye of formula (I). The silver halide is sensitized with such a spectral sensitizing dye in a known manner such that the spectral sensitizing dye adsorbs to the silver halide.

The non-light sensitive layer in which the absorber dye is preferably located, may be above or below the light sensitive layer, and be on the same side of a support of the element but most preferably on the side of the support opposite to that on which the light sensitive layer is located.

All heterocyclic and aromatic groups (which includes aryl and arylthio) described above, may particularly have from 6 to 20, or from 6 to 15, carbon atoms. All heteroaryl groups may particularly have from 4 to 7 (or 5 or 6) carbon atoms, with 1, 2, 3 or 4 heteroatoms selected from O, N, S or Si. Examples of aromatic groups include phenyl, tolyl, and the like, any of which may be substituted or unsubstituted. Examples of heteroaryl include thienyl, pyrrolyl, and furyl.

All alkyl, alkoxy, alkenyl, alkylthio, acyl, acyloxy, alkoxycarbonyl, alkylsulfonyl, carbamoyl, or sulfamoyl groups described herein, may particularly have from 1 to 20 carbon atoms (or 1 to 10 or 1 to 8 carbon atoms; or even 1, 2, 3 or 4 carbon atoms). All of these groups may be linear, branched or cyclic (and, with appropriate substituents includes heterocyclic such as 4-piperidyl). Examples of alkyl include methyl, ethyl, propyl, and the like.

Examples of $X_1$ and $X_2$ include benzothiazole; benzoxazole; thiazoline; 1,3,4-thiadiazole; 2-quinoline; 4-quinoline; naphtho[1,2-d]thiazole; 3,3-dimethylindole.

The rings formed by $X_1$ and $X_2$ and $Z_1$ and $Z_2$, since they are specified "groups", may optionally be further substituted (that is, they may have further substituents than those on the bonds shown). For example, such rings may have 1 or 2 to 4 further substituents. Substituents may, for example, independently be, 1 to 18 carbon alkyl (or 1 to 6, or 1 to 2 carbon alkyl), aromatic (such as 6 to 20 carbon atoms, particularly aryl), heteroaryl (such as pyrrolyl, furyl or thienyl), aryloxy (such as 6 to 20 carbon atoms), alkoxy (such as 1 to 6 or 1 to 2 carbon alkoxy), cyano, or halogen (for example F or Cl). Such substituents can also include a ring fused thereto, such as a benzene group, pyrrolo group, furyl group or thienyl group, where not otherwise indicated (formula (II) to (IV) dyes excluding, for example, fused rings on the benzene or naphthalene rings for $Z_1$ and $Z_2$). Any of the alkyl and alkoxy substituents may have from 1 to 5 (or 1 to 2) intervening oxygen, sulfur or nitrogen atoms.

Substituents on any of the specified substituent groups in any of the formula (I) type dyes defined above (including any of those substituents described for $X_1$, $X_2$, $Z_1$ and $Z_2$, as well as for any of the L, $R_1$ to $R_3$ or $R_7$ or $R_8$), can include halogen (for example, chloro, fluoro, bromo or iodo), alkoxy (particularly 1 to 10 or 1 to 6 carbon atoms; for example, methoxy, ethoxy), substituted or unsubstituted alkyl (particularly of 1 to 10 or 1 to 6 carbon atoms, for example, methyl, trifluoromethyl), amido or carbamoyl (particularly of 1 to 10 or 1 to 6 carbon atoms), alkoxycarbonyl (particularly of 1 to 10 or 1 to 6 carbon atoms), and other known substituents, and substituted and unsubstituted aryl (particularly of 1 to 10 or 1 to 6 carbon atoms, for example, phenyl or 5-chlorophenyl), heteroaryl such as those having a 5 or 6-membered ring containing 1 to 3 heteroatoms selected from N, O, or S (for example, pyridyl, thienyl, furyl or pyrrolyl), alkylthio (particularly of 1 to 10 or 1 to 6 carbon atoms, for example, methylthio or ethylthio), hydroxy or alkenyl (particularly of 1 to 10 or 1 to 6 carbon atoms), cyano and others known in the art. Additionally, any of the substituents may optionally be non-aromatic.

Further, it will be understood that where possible, any of the non-aromatic substituents can be branched or unbranched and include ring structures (this is particularly true with regard to any alkyl group or alkylene group). This also includes the possibility of the methine groups L forming ring structures with themselves or with, for example, $R_1$ or $R_2$.

Examples of dyes of the present invention include the following:

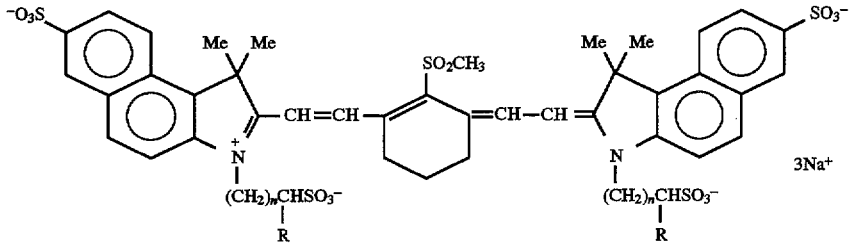

| | n | R |
|---|---|---|
| Dye 1 | 1 | H |
| Dye 2 | 2 | H |
| Dye 3 | 2 | $CH_3$ |
| Dye 4 | 3 | H |

Dye 5

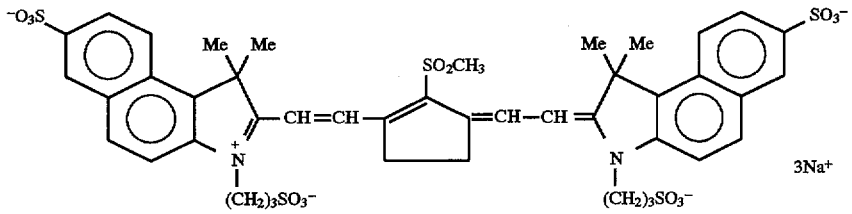

Dye 6

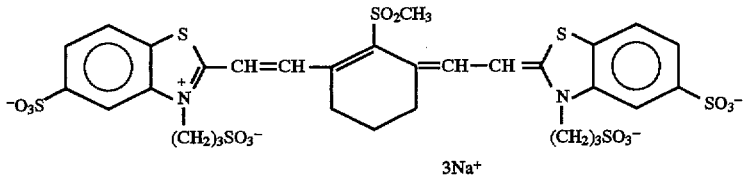

Dye 7

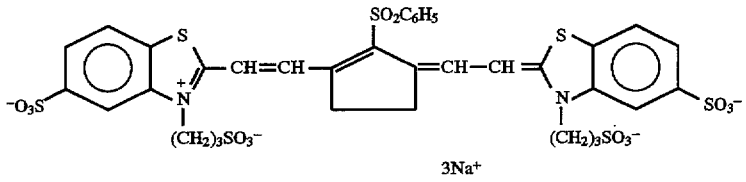

Dye 8

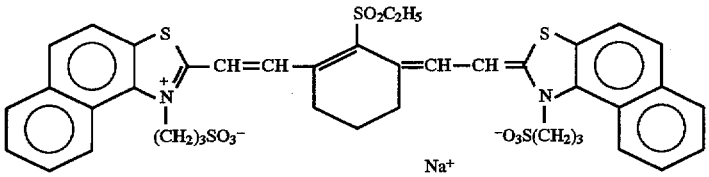

Dye 9

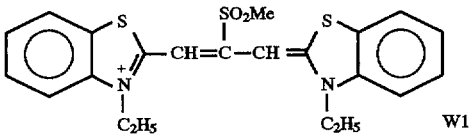

Dye 10

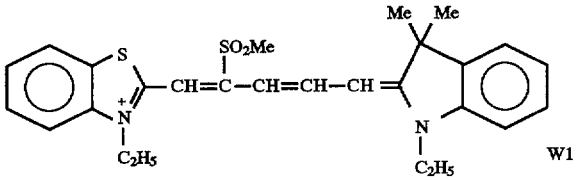

Dyes of formula (I) can be prepared by using techniques such as described in F. M. Hamer, *Cyanine Dyes and Related Compounds*, Wiley, New York, 1964. The foregoing reference and all other references cited herein, are incorporated herein by reference. Particularly, the dyes of formula (I) can be prepared by using a corresponding dye of the same structure as that desired but with a —Cl (or other halogen, such as Br) instead of the —$SO_2R_3$ group, and replacing the halogen with —$SO_2R_3$ in a manner similar to that described in the examples below. Corresponding dyes with halogen substituents can also be prepared by techniques described in the Hamer reference, or according to methods referenced in U.S. Pat. No. 5,260,178.

Dyes of formula (I) may be provided in a layer of a photographic element by adding them to the vehicle of the layer, such as a gelatin solution, as a solution in water or an alcohol. The dye may be incorporated into the present materials in amounts such as from 5 to 500, preferably from 50 to 350, more preferably from 100 to 300 mg of dye per mole of silver halide in the emulsion layer or the same amounts in mg/m$^2$. For the preferred application as a dye to aid in detection in devices such as imagesetters, the amount of the dye of formula (I) is preferably between 5 to 20 mg/m$^2$.

Photographic elements of the present invention will typically have at least one light sensitive silver halide emulsion layer and a support. They are preferably black and white elements such as used in Graphic Arts applications. Typically, such element will have at least 3 layers, namely a gel underlayer, the photosensitive emulsion layer and an overcoat layer, coated in that sequence on a support. A gelatin layer (often referred to as a "pelloid" layer) will also typically be provided on the side of the support opposite that on which the foregoing layers are coated. However, alternative coating formats may be employed. For example, a gel interlayer may be coated between the emulsion and overcoat and/or there is no layer between the support and the emulsion layer.

However, photographic elements of the present invention can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler.

Photographic elements of the present invention can also contain additional layers, such as filter layers, interlayers, overcoat layers, subbing layers, and the like. All of the layers of photographic elements of the present invention, can be coated on a support which can be transparent or reflective (for example, a paper support). For paper materials, it is customary to employ a fluorescent brightening agent. These may be incorporated into the materials by known techniques, for example by dissolving a water-soluble brightener in the gelatin supercoat (the layer most remote from the support). In one embodiment a water-insoluble brightener may be used. It may be imbibed onto particles of a polymer dispersion as described in British Patent Specifications 1,504,949 or 1,504,950, or dissolved in droplets of coupler solvents prior to incorporation in a layer of the material (for example, in the overcoat).

Photographic elements of the present invention may also usefully include a magnetic recording material as described in *Research Disclosure,* Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns.

In the following discussion of suitable materials for use in photographic elements, reference will be made to *Research Disclosure,* September 1994, Number 365, Item 36544, published by Kenneth Mason Publications, Ltd., Dudley Annex, 12a North Street, Emsworth, Hampshire PO10 7DQ, England, which will be identified hereafter by the term "Research Disclosure I." The Sections hereafter referred to are Sections of the Research Disclosure I.

The silver halide emulsions employed in the photographic elements may be negative-working, such as surface-sensitive emulsions or unfogged internal latent image forming emulsions, or positive working emulsions of internal latent image forming emulsions (that are either fogged in the element or fogged during processing). Suitable emulsions and their preparation as well as methods of chemical and spectral sensitization are described in Sections I through V. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

The film will preferably have silver halide with an average edge length of less than or equal to 0.18 μm in an amount of less than or equal to 3.5 g Ag/m$^2$. Silver halides in such films have diminishing absorption and scatter in the region of 880 nm as the grains become smaller and, to a much lesser extent, diminishing scatter when less silver halide is coated in the emulsion layer. Hence absorber dyes of formula (I) are particularly useful in such elements where the silver halide size and coverage leads to poor detection in imagesetting devices, for example.

Supports for the photographic elements can be transparent or reflective (for example, a paper support). Such supports include polymeric films such as cellulose esters (for example, cellulose triacetate and diacetate) and polyesters of dibasic aromatic carboxylic acids with divalent alcohols (for example, poly(ethylene-terephthalate), poly(ethylene-naphthalates)), paper and polymer coated paper. Such supports are described in further detail in *Research Disclosure I,* Section XV. The preferred support for Graphic Arts elements is polyethylene terephthalate with a conventional Graphic Arts anti-halation backcoat or "pelloid" (that is, on the side of the support opposite the side upon which the light sensitive silver halide is provided) designed to absorb light of the appropriate wavelength.

The photographic elements may also contain materials that accelerate or otherwise modify the processing steps of bleaching or fixing to improve the quality of the image. Bleach accelerators described in EP 193,389; EP 301,477; U.S. Pat. No. 4,163,669; U.S. Pat. No. 4,865,956; and U.S. Pat. No. 4,923,784 are particularly useful. Also contemplated is the use of development accelerators or their precursors (UK Patent 2,097,140; UK Patent 2,131,188); electron transfer agents (U.S. Pat. No. 4,859,578; U.S. Pat. No. 4,912,025); antifogging agents such as derivatives of hydroquinones, aminophenols, amines, gallic acid; catechol; ascorbic acid; and sulfonamidophenols.

The elements may also contain filter dye layers comprising colloidal silver sol or yellow and/or magenta filter dyes, either as oil-in-water dispersions, latex dispersions or as solid particle dispersions.

The emulsions and materials to form the photographic elements may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805.

The silver halide emulsion used for elements of the present invention, and which is sensitized by a dye of formula (I), is preferably of the type that provides a high contrast image as required in Graphic Arts applications. Such emulsions are customarily relatively high in silver chloride and low in silver iodide. They may contain both silver bromide and silver iodide in addition to silver chloride. Preferably the iodide content of these emulsions is less than 10 mole percent. Substantially pure silver chloride emulsions may be used for this purpose, that is emulsions having at least 90% silver chloride or more (for example, at least 95%, 98%, 99% or 100% silver chloride). In such a case the possibility is also contemplated that the silver chloride could be treated with a bromide source to increase its sensitivity, to provide an equivalent bulk bromide level of 2 to 2.5% or between about 0.6 to 1.2%. However, the preferred emulsions comprise at least 50% (most preferably 70%) chloride and less than 50% (most preferably 30%) bromide. The foregoing percentage figures are in mole percent.

As is known in the Graphic Arts field the grains may be doped with rhodium, ruthenium, iridium or other Group VIII metals, preferably at levels in the range $10^{-9}$ to $10^{-3}$, preferably $10^{-6}$ to $10^{-3}$, mole metal per mole of silver. The preferred Group VIII metal is rhodium.

The type of silver halide grains preferably include polymorphic, cubic, and octahedral. The grain size of the silver halide may have any distribution known to be useful in photographic compositions, and may be ether polydispersed or monodispersed. The silver halide emulsions employed in the photographic elements may be negative-working, such as surface-sensitive emulsions or unfogged internal latent image forming emulsions, or positive working emulsions or internal latent image forming emulsions (that are either fogged in the element or fogged during processing).

Tabular grain silver halide emulsions may also be used. Tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area. The tabular grain emulsions can be high aspect ratio tabular grain emulsions—i.e., ECD/t>8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (T), where T (i.e., $ECD/t^2$) >25 and ECD and t are both measured in microns (μm). The tabular grains can be of any thickness compatible with achieving an aim average aspect ratio and/or average tabularity of the tabular grain emulsion. Preferably the tabular grains satisfying projected area requirements are those having thicknesses of <0.3 μm, thin (<0.2 μm) tabular grains being specifically preferred and ultrathin (<0.07 μm) tabular grains being contemplated for maximum tabular grain performance enhancements. When the native blue absorption of iodohalide tabular grains is relied upon for blue speed, thicker tabular grains, typically up to 0.5 μm in thickness, are contemplated.

High iodide tabular grain emulsions are illustrated by House U.S. Pat. No. 4,490,458, Maskasky U.S. Pat. No. 4,459,353 and Yagi et al EP 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated in those references cited in *Research Disclosure. I,* Section I.B.(3) (page 503).

The silver halide grains may be prepared according to methods known in the art, such as those described in *Research Disclosure I* and James, *The Theory of the Photographic Process.* These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, ruthenium, rhodium, phosphorous, or combinations thereof. Chemical sensitization is generally carried out at pAg levels of from 5 to 10, pH levels of from 3 to 6, and temperatures of from 30° to 80° C., as described in *Research Disclosure I,* Section IV (pages 510–511) and the references cited therein.

The sensitizing dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye of formula (I) is typically used in a silver halide emulsion (typically in a silver halide emulsion containing layer) in an amount of from 5 to 500 mg per mole of silver halide (preferably from 50 to 350, and more preferably from 100 to 300 mg per mole of silver halide emulsion). The dye/silver halide emulsion may be mixed with a dispersion of color image-forming coupler immediately before coating or in advance of coating (for example, 2 hours).

The photographic elements can be imagewise exposed using any of the known techniques for graphic arts films. Such exposure may include exposure to radiation having a wavelength of from about 550–750 nm, preferably between about 600–690 nm. Exposure may be to a real image through a lens. However, exposure may be by exposure to a computer stored or Generated image by means of light emitting devices (such as light controlled by light valves, CRT and the like).

The photographic elements can be processed by any known process. Processing is described in *Research Disclosure I,* Sections XIX and XX, or in T. H. James, editor, *The Theory of the Photographic Process,* 4th Edition, Macmillan, New York, 1977.

In the case of preferred Graphic Arts films, the light sensitive silver halide contained in the photographic elements is preferably processed following exposure to form a visible image, by associating the silver halide with an alkaline medium in the presence of a developing agent contained in the medium or in the element. When the photographic elements contain incorporated developing agents, the elements can be processed in the presence of an activator.

The present invention, as already described, provides that the hydrazine nucleator and/or amine booster, can be provided in a processing solution (particularly the developer) rather than being incorporated into the element. However, it is preferred that both the nucleating agent and amine booster be incorporated in the element. In either case, it will be appreciated that the element is developed in the presence of the nucleating agent and the amine booster.

as diethylene glycol, can also be included to facilitate the solvency of organic components. The developers contain one or a combination of conventional developing agents, such as polyhydroxybenzene, aminophenol, paraphenylenediamine, ascorbic acid, pyrazolidone, pyrazolone, pyrimidine, dithionite, hydroxylamine, or other conventional developing agents.

It is preferred when processing the preferred Graphic Arts films constructed according to the present invention, to use hydroquinone and 3-pyrazolidone developing agents in combination. The pH of the developers can be adjusted with alkali metal hydroxides and carbonates, borax and other basic salts. To reduce gelatin swelling during development, compounds such as sodium sulfate can be incorporated into the developer. Also, compounds such as sodium thiocyanate can be present to reduce granularity. Chelating and sequestering agents, such as ethylenediaminetetraacetic acid or its sodium salt, can be present. Generally, any conventional developer composition suitable for Graphic Arts films, can be employed in processing the preferred Graphic Arts films of this invention. Specific illustrative photographic developers are disclosed in the *Handbook of Chemistry and Physics,* 36th Edition, under the title "Photographic Formulae" at page 3001 et seq. and in *Processing Chemicals and Formulae,* 6th Edition, published by Eastman Kodak Company (1963). Graphic Arts elements can, of course, be processed with conventional developers for lithographic photographic elements, as illustrated by U.S. Pat. No. 3,573,914 and UK Patent No. 376,600.

Further details on the construction and processing of Graphic Arts elements of the present type, can be found in U.S. Pat. No. 4,975,354. However, as already described, elements of the present invention must have a light sensitive silver halide emulsion and must also contain a layer including a dye of formula The method of the present invention will be further described in the examples below.

EXAMPLE 1: Preparation of Dye 4.

Dye B (3.15 g, 0.003 mole) (see formula below) was dissolved in dimethyl sulfoxide (30 mL) and sodium methanesulfinate (0.33 g, 0.0033 mole) was added. The mixture was stirred at room temperature for 1 hr, filtered and poured slowly into 150 mL of stirred acetone. The crude dye was collected and purified by recrystallization from 50% aqueous ethanol (100 mL), yielding 2.28 g of gold colored crystals of Dye 4, $\lambda_{max}$ 873 nm (MeOH).

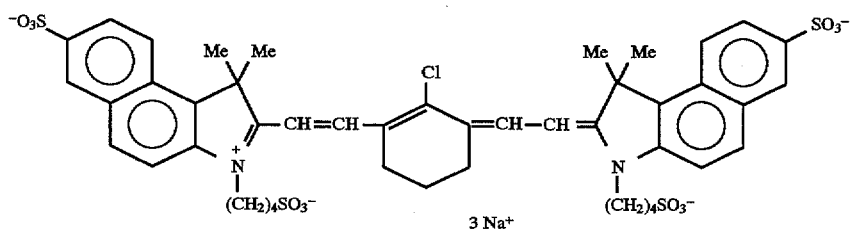

Dye B

Very high contrast images can be obtained in Graphic Arts films by processing at pH values in the range 11 to 12.3, but preferably lower pH values, for example below 11 and most preferably in the range 10.3 to 10.5 are employed for processing the photographic recording materials as described herein.

The developers for the preferred Graphic Arts films are typically aqueous solutions, although organic solvents, such

EXAMPLE 2:

A series of typical pelloid layers were coated on polyethylene terephthalate film base, incorporating Dye 4 at coverages of 0, 10, 20, 30 or mg/m$^2$ (pelloid layers A through E, respectively). Each pelloid layer also incorporated the four absorber dyes ABS1, ABS2, ABS3 and ABS4 at coverages of 304.5, 202.4, 28.0 and 187.5 mg/m$^2$, respectively, and had a total gelatin content of 3.0 g dry gelatin/m$^2$. The pelloid layer was simultaneously overcoated with a supercoat with a gelatin coverage of 0.488 g dry gelatin/m$^2$. The supercoat contained matting beads, lubricants and surfactants to aid coating. The whole pelloid layer was hardened with bis(vinylsulfonyl)methane at 4.5% of the total dry gelatin.

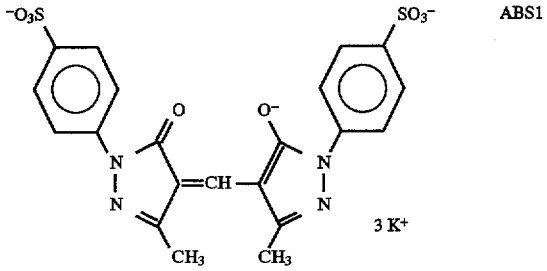

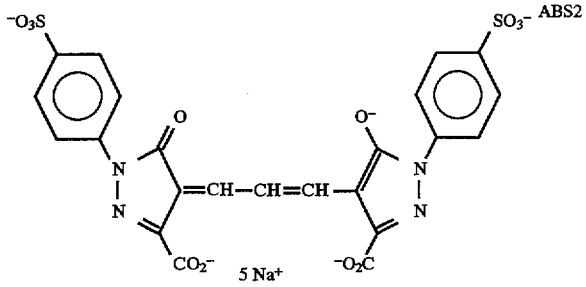

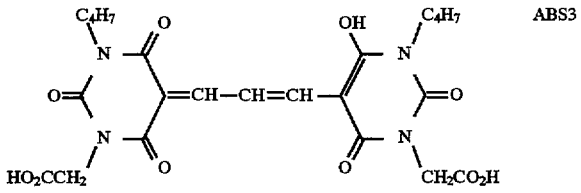

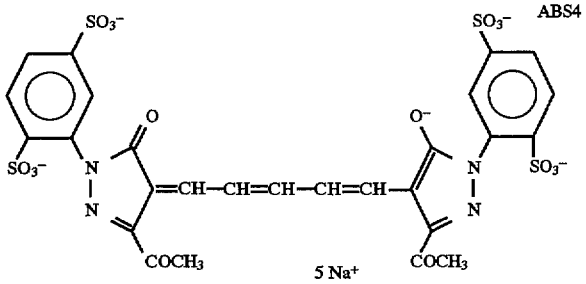

The absorptance (A) of the pelloid layers at 880 nm was calculated from measurements of the transmittance (T) and reflectance (R), where A=1−(R+T), and expressed as a percentage. The electrical current detection signal given by a 5 volt 880 nm detection device, similar in construction to those employed in a Linotype Hell "Herkules" imagesetter, was also measured. For this device it was known that a current of about 40 mA was sufficient to give detection. The results are shown in Table 1.

TABLE 1

880 nm absorptance and detector current value of film pelloid layers containing Dye 4.

| Pelloid Layer | Dye 4 mg/m$^2$ | Absorptance (%) at 880 nm | Detector Current (mA) |
|---|---|---|---|
| A | 0 | 0 | 16.2 |
| B | 10 | 18.8 | 23.2 |

TABLE 1-continued 880 nm absorptance and detector current value of film pelloid layers containing Dye 4.

| Pelloid Layer | Dye 4 mg/m$^2$ | Absorptance (%) at 880 nm | Detector Current (mA) |
|---|---|---|---|
| C | 20 | 34.1 | 31.6 |
| D | 30 | 47.3 | 44.6 |
| E | 40 | 57.4 | 60.2 |

The values given in Table 1 show that dye coverages 30 mg/m$^2$ and above result in readily detectable pelloid layers.

For each of the coatings A, B and C, a three layer aqueous gelatin formulation, the bottom layer of which contained a silver bromochloride emulsion, was coated on the side of the support opposite from the pelloid layer. The emulsion layer had a gelatin coverage of 1.8 g dry gelatin/m$^2$, the intermediate layer a gelatin coverage of 0.65 g/m$^2$ and a supercoat (top layer) a gelatin coverage of 0.976 g/m$^2$. The supercoat also contained surfactants to aid coating and a matting agent. The whole pack was hardened with bis(vinylsulfonyl) methane at 3.5% of the total dry gelatin.

Four different emulsion layers (I through IV) were used in each of the above elements, as identified in Table 2 below.

TABLE 2

Emulsion layers.

| | I | II | III | IV |
|---|---|---|---|---|
| Ag, g/m 2 | 2.81 | 3.30 | 2.81 | 3.30 |
| Average silver halide edge length, μm | 0.13 | 0.13 | 0.18 | 0.18 |

Each of the resulting films was then assessed on the 880 nm test apparatus as described in Example 1. The results are provided in Table 3 below.

TABLE 3

Detector current (mA) of pelloid coatings A, B and C, coated with emulsion packs incorporating layers I, II, III and IV.

| | I | II | III | IV |
|---|---|---|---|---|
| A | 25.8 | 26.4 | 40.7 | 42.4 |
| B | 38.4 | 39.1 | 58.5 | 62.8 |
| C | 51.8 | 51.5 | 83.5 | 83.9 |

It can be seen that the film with the standard pelloid A (which lacks the dye of the invention) in combination with a fine grain (0.13 μm edge length) emulsion (I or II) gives insufficient current to be detected by imagesetters, whereas emulsions of larger grain size, for example, 0.18 μm average edge length (examples III or IV) have sufficient scatter and have attained the 40 mA threshold value, making them detectable. Furthermore, it will be noticed that there is relatively little difference in detection levels between silver coverages of 2.81 and 3.30 g Ag/m$^2$ for both emulsions. No infra-red absorption attributable to an aggregated state of Dye 4 was detectable in any of the above coatings.

The data of Table 3 further show that addition of the dye of formula (I) to the pelloid at a coverage between 10 and 20 mg/m$^2$ for films containing fine grain emulsions results in sufficient detector current to give detection in imagesetters.

While the invention has been described in detail with particular reference to preferred embodiments, it will be understood that variations and modifications can be effected within the spirit and scope of the invention.

We claim:

1. A photographic element having a light sensitive layer and which element contains a dye of the formula:

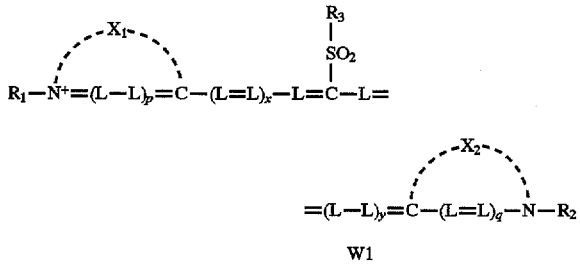

$X_1$ and $X_2$ each independently represent the atoms necessary to complete a 5- or 6-membered heterocyclic nucleus;

x and y are, independently, integers from 0 to 3 provided x+y is no greater than 4;

p and q each independently represents 0 or 1, each L independently represents a methine group;

$R_1$ and $R_2$ each independently represents an alkyl group or an aryl group, and $R_3$ represents an alkyl group, aryl group or heteroaryl group;

W1 is a counterion as needed to balance the charge of the molecule.

2. A photographic element according to claim 1 wherein p and q are both 0.

3. A photographic element according to claim 1 wherein the S of $—SO_2R_3$ is bonded to the carbon of the methine in the middle of the chain of methine groups represented by all the L groups shown.

4. A photographic element according to claim 3 wherein the dye is of the formula:

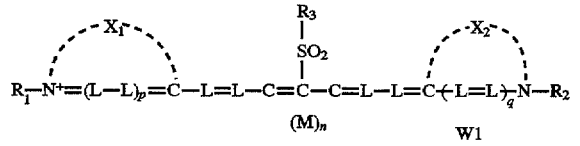

$X_1$ and $X_2$ each independently represent the atoms necessary to complete a 5- or 6-membered heterocyclic nucleus;

p and q each independently represents 0 or 1, each L independently represents a methine group;

$R_1$ and $R_2$ each independently represents an alkyl group or an aryl group, and $R_3$ represents an alkyl group, aryl group or heteroaryl group;

each M is independently a methylene group;

n is 2 or 3; and

W1 is a counterion as needed to balance the charge of the molecule.

5. A photographic element according to claim 4 wherein the dye is of the formula:

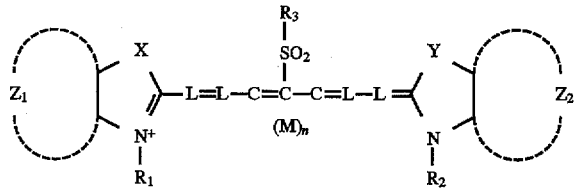

wherein:

X and Y independently represent O, Se, S, $NR_6$ or

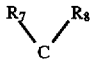

wherein:

$R_6$, $R_7$ and $R_8$ independently represent H, alkyl group or aryl group, and the $R_7$ and $R_8$ in X may be the same as, or different from, the $R_7$ and $R_8$ in Y;

$Z_1$ and $Z_2$ are, independently, a benzene or naphthalene group.

6. A photographic element according to claim 5 wherein X and Y are both the following:

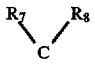

where the $R_7$ and $R_8$ on X may be the same as, or different from, the $R_7$ and $R_8$ on Y.

7. A photographic element according to claim 6 wherein both of the $R_7$ groups are the same as each other, and both of the $R_8$ groups are the same as each other.

8. A photographic element according to claim 7 wherein the dye is symmetrical about the carbon atom to which the $—SO_2R_3$ group is attached.

9. A photographic element according to claim 6 wherein each L is an unsubstituted methine.

10. A photographic element according to claim 6 wherein the dye is of the formula:

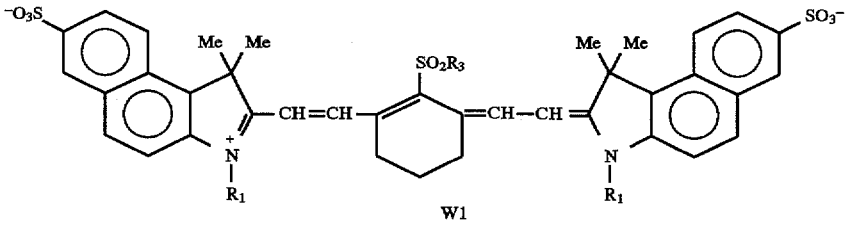

wherein both $R_1$ groups are the same and represent a sulfoalkyl group.

11. A photographic element according to claim 5 wherein the dye has at least two acid or acid salt groups.

12. A photographic element according to claim 5 wherein $Z_1$, $Z_2$, $R_1$ and $R_2$ each has at least one acid or acid salt group.

13. A photographic element according to claim 1 wherein the dye is present in the element in a monomeric state.

14. A photographic element having a light sensitive silver halide layer and which element contains as an absorber dye a dye of the formula:

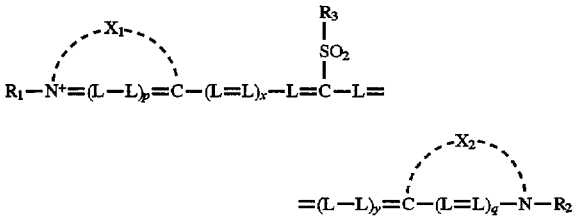

W1

$X_1$ and $X_2$ each independently represent the atoms necessary to complete a 5- or 6-membered heterocyclic nucleus;

x and y are, independently, integers from 0 to 3 provided x+y is no greater than 4;

p and q each independently represents 0 or 1, each L independently represents a methine group;

$R_1$ and $R_2$ each independently represents an alkyl group or an aryl group, and $R_3$ represents an alkyl group, aryl group or heteroaryl group;

W1 is a counterion as needed to balance the charge of the molecule.

15. A photographic element according to claim 14 wherein the element additionally has a non-light sensitive layer and the dye is present only in the non-light sensitive layer.

16. A photographic element according to claim 15 wherein the element additionally comprises a support, and wherein the non-light sensitive layer containing the dye is located on the side of the support opposite to the light sensitive layer.

17. A photographic element according to claim wherein the dye is of the formula:

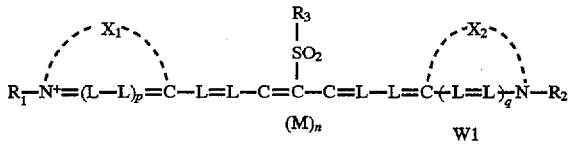

W1

$X_1$ and $X_2$ each independently represent the atoms necessary to complete a 5- or 6-membered heterocyclic nucleus;

p and q each independently represents 0 or 1, each L independently represents a methine group;

$R_1$ and $R_2$ each independently represents an alkyl group or an aryl group, and $R_3$ represents an alkyl group, aryl group or heteroaryl group;

each M is independently a methylene group;

n is 2 or 3; and

W1 is a counterion as needed to balance the charge of the molecule.

18. A photographic element according to claim 17 wherein the dye is present in a monomeric state.

19. A photographic element according to claim 18 wherein each L is an unsubstituted methine.

20. A photographic element according to claim 18 wherein the dye is of the formula:

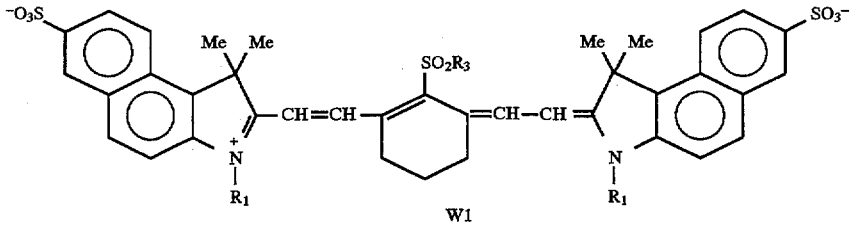

W1 wherein both $R_1$ groups are the same and represent a sulfoalkyl group.

21. A photographic element according to claim 18 wherein the element contains silver halide grains with an average edge length of less than or equal to 0.18 microns in an amount of less than or equal to 3.5 g $Ag/m^2$.

22. A photographic element according to claim 17 wherein the dye has at least two acid or acid salt groups.

23. A photographic element according to claim 17 wherein $X_1$, $X_2$, $R_1$ and $R_2$ each has at least one acid or acid salt group.

* * * * *